US011441769B1

(12) United States Patent
Zhu

(10) Patent No.: US 11,441,769 B1
(45) Date of Patent: Sep. 13, 2022

(54) MULTIFUNCTIONAL OUTDOOR WATERPROOF WALL LAMP

(71) Applicant: Zhongshan weihua lighting co., ltd, Zhongshang (CN)

(72) Inventor: Xiaohua Zhu, Guangdong (CN)

( * ) Notice: Subject to any disclaimer, the term of this patent is extended or adjusted under 35 U.S.C. 154(b) by 0 days.

(21) Appl. No.: 17/534,428

(22) Filed: Nov. 23, 2021

(30) Foreign Application Priority Data

Oct. 20, 2021 (CN) ..... 202122518046.0

(51) Int. Cl.

| | |
|---|---|
| ***F21V 17/12*** | (2006.01) |
| ***F21V 15/01*** | (2006.01) |
| ***F21S 8/00*** | (2006.01) |
| ***F21V 23/06*** | (2006.01) |
| ***F21V 21/26*** | (2006.01) |
| ***F21V 23/04*** | (2006.01) |
| ***F21V 31/00*** | (2006.01) |

(52) U.S. Cl.
CPC ..... *F21V 31/005* (2013.01); *F21S 8/033* (2013.01); *F21V 15/01* (2013.01); *F21V 17/12* (2013.01); *F21V 21/26* (2013.01); *F21V 23/04* (2013.01); *F21V 23/06* (2013.01)

(58) Field of Classification Search
CPC ..... F21V 31/005; F21V 15/01; F21V 17/12; F21V 21/26; F21V 23/04; F21V 23/06; F21S 8/033
See application file for complete search history.

(56) References Cited

U.S. PATENT DOCUMENTS 3,116,023 A * 12/1963 Van Dusen, Jr. ..... F21V 23/04 439/135

FOREIGN PATENT DOCUMENTS

WO WO-03058119 A1 * 7/2003 ..... F21V 23/06

* cited by examiner

*Primary Examiner* — Anabel Ton

(57) ABSTRACT

The present invention discloses a multifunctional outdoor waterproof wall lamp including a waterproof lamp. The top end of the waterproof lamp is provided with a second connecting hole, and a multifunctional sensor is attached to the top end of the waterproof lamp. With a sensor adjustment switch and a sensor mode switch, usage modes of the device may be adjusted and switched well; with a socket, the device may be formed with an external power socket which is convenient for the surrounding people to use, the applicable scenarios are more diverse and more convenient, the connection between products and the lamp is simple, and the compatibility is strong, which is convenient for replacing waterproof lamps of various types; and with a waterproof cover, a good waterproof function can be realized, and after a product is preset, it can be directly powered on and used without repeated switching, thus realizing individual demand and energy saving, firm product structure, smart product structure, less visible screws and aesthetic appearance, and realizing multifunctional integration of smart lamps and sockets, convenient installation and long service life.

4 Claims, 4 Drawing Sheets

MULTIFUNCTIONAL OUTDOOR WATERPROOF WALL LAMP

TECHNICAL FIELD

The present invention relates to the field of wall lamps, and in particular to a multifunctional outdoor waterproof wall lamp.

BACKGROUND ART

Wall lamps are assistant lighting decorative lamps mounted on indoor walls and usually equipped with milk white glass lampshades. The wall lamps are mostly mounted on balconies, stairs, corridors, passages, and bedrooms and suitable for use as ever-burning lamps; color-changing wall lamps are mostly used in festivals and celebrations; bedside wall lamps are mostly mounted on the upper left of beds and has lamp heads that can be rotated in all directions and light beams that are concentrated so as to facilitate reading; and mirror front wall lamps are mostly used near bathroom mirrors.

Existing wall lamps have relatively simple structures and, only play a role of lighting when in use. With the progress and development of the society, the wall lamps are increasingly common in family life, but can not meet decoration and usage requirements of people due to their single functions. Therefore, there is a need for a multifunctional wall lamp that can meet the decoration and usage requirements of people.

SUMMARY OF THE INVENTION

In order to solve the above existing problems, the present invention provides a multifunctional outdoor waterproof wall lamp.

The present invention is implemented by the following technical solution:

A multifunctional outdoor waterproof wall lamp comprises a waterproof lamp, wherein the top end of the waterproof lamp is provided with a second connecting hole, a multifunctional sensor is attached to the top end of the waterproof lamp and provided with a first connecting hole, and the axial center of the first connecting hole is aligned with the axial center of the second connecting hole; a waterproof cover is attached to the top end of the multifunctional sensor; a hollow threaded rod is threadedly connected in both the first connection hole and the second connection hole, and the top end of the hollow threaded rod passes through the waterproof cover and is threadedly connected with an internally threaded aluminum piece; the waterproof lamp is provided with a main body case on one side and an internally threaded aluminum piece is fixedly mounted to the waterproof lamp on one side; one end of a connecting screw is threadedly connected in the internally threaded aluminum piece, the other end of the connecting screw extends into the main body case where a connecting nut is provided, and the connecting nut is threadedly connected with the connecting screw; a sensor adjustment switch and a sensor mode switch are fixedly mounted on the multifunctional sensor; a mounting groove is provided on one side of the main body ease, and a mounting shell is fixedly embedded in the mounting groove; a sealing, ring is attached to one side of the mounting shell, a socket is inserted into and slidably connected to the mounting shell, and the sealing ring is disposed between the socket and one side of the mounting shell; a bracket is disposed in the main body case and fixedly connected to an inner wall on one side of the main body case; and an insulating shell is fixedly mounted on an inner top surface of the mounting groove, a water blocking cover is hinged in the insulating shell, and a torsion spring is mounted at a movable joint between the water blocking cover and the insulating shell.

Preferably, the water blocking cover is T-shaped as a whole and a hinge pin is inserted into the water blocking cover, the torsion spring is sleeved on the hinge pin at the water blocking cover, one end of the torsion spring is fixedly connected to the water blocking cover, and the other end of the torsion spring is fixedly connected to an inner wall of the mounting groove.

Preferably, the bracket is formed by combining a transverse plate and a U-shaped plate via bolts, both ends of the U-shaped plate in the bracket are threadedly connected with bolts respectively, and the U-shaped plate in the bracket is threadedly connected with the inner wall on one side of the main body case via bolts.

Preferably, gaskets are fixedly mounted at both the top end and the bottom end on one side of the socket and provided with threaded holes where bolts are threadedly connected, and the socket is fixedly connected to the mounting shell via a plurality of bolts.

Compared with the related art, the beneficial effects of the present invention are as follows: with the sensor adjustment switch and the sensor mode switch, usage modes of the device may be adjusted and switched well; with the socket, the device may be formed with an external power socket which is convenient for the surrounding people to use, the applicable scenarios are more diverse and more convenient, the connection between products and the lamp is simple, and the compatibility is strong, which is convenient for replacing waterproof lamps of various types; and with the waterproof cover, a good waterproof function can be realized, and after a product is preset, it can be directly powered on and used without repeated switching, thus realizing individual demand and energy saving, firm product structure, smart product structure, less visible screws and aesthetic appearance, and realizing multifunctional integration of smart lamps and sockets, convenient installation and long service life.

In the figures: 1—Waterproof lamp; 2—Internally threaded aluminum piece; 3—Multifunctional sensor; 4—Waterproof cover; 5—Internally threaded aluminum piece; 6—Main body case; 7—Water blocking cover; 8—Socket; 9—Mounting shell; 10—Sealing ring; 11—Insulating shell; 12—Torsion spring; 13—Mounting groove; 14—Bracket 15—Connecting screw; 16—Sensor adjustment, switch; 17—Sensor mode switch; 18—Hollow threaded rod; 19—First connecting hole; 20—Second connecting hole; 21—Connecting nut.

DETAILED DESCRIPTION OF EMBODIMENTS

Figure 1:
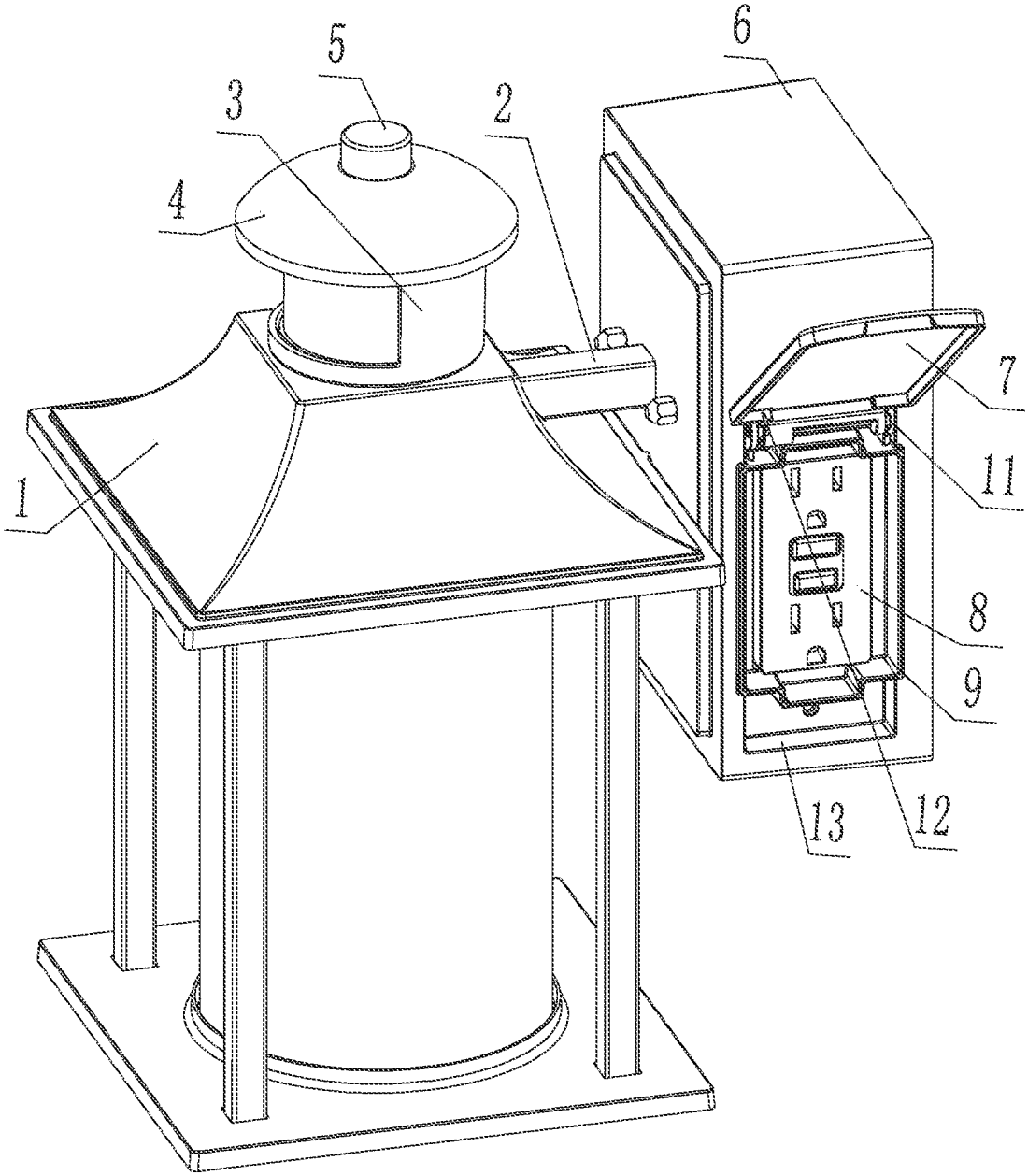
FIG. 1 is a three-dimensional view of a structure according to the present invention.
Figure 2:
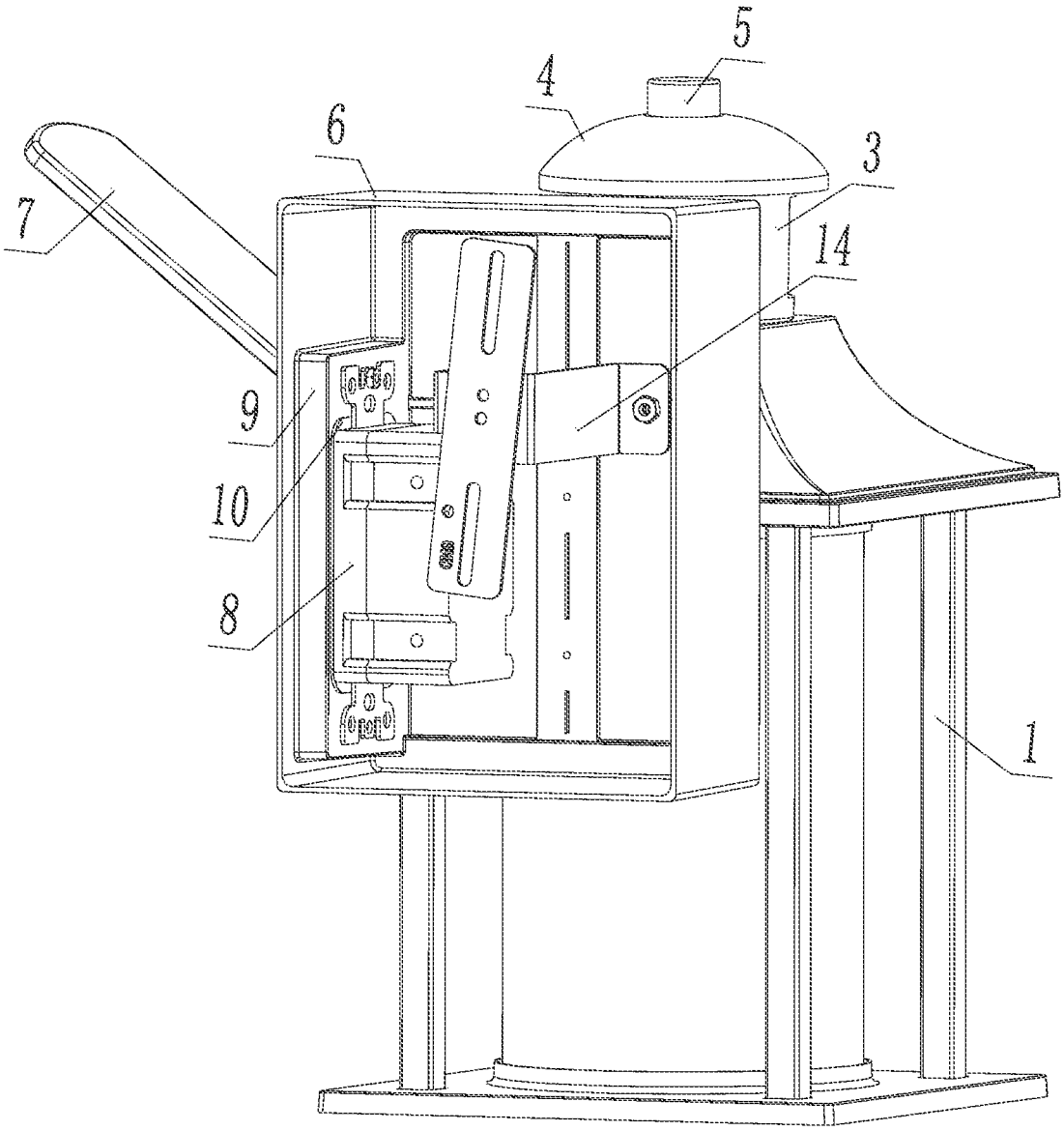
FIG. 2 is a side view of the structure in FIG. 1 according to the present invention.
Figure 3:
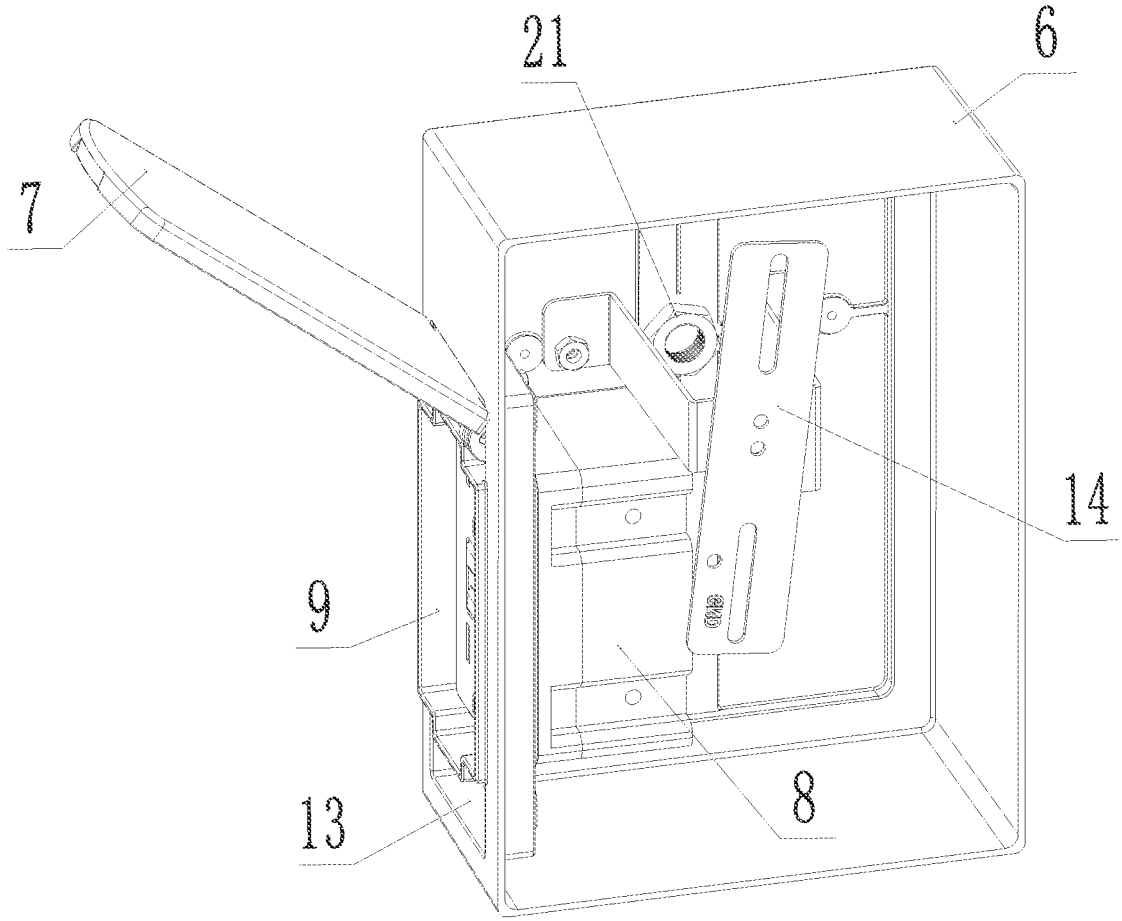
FIG. 3 is a schematic view of a partial structure of a main body case in FIG. 2 of the structure according to the present invention.
Figure 4:
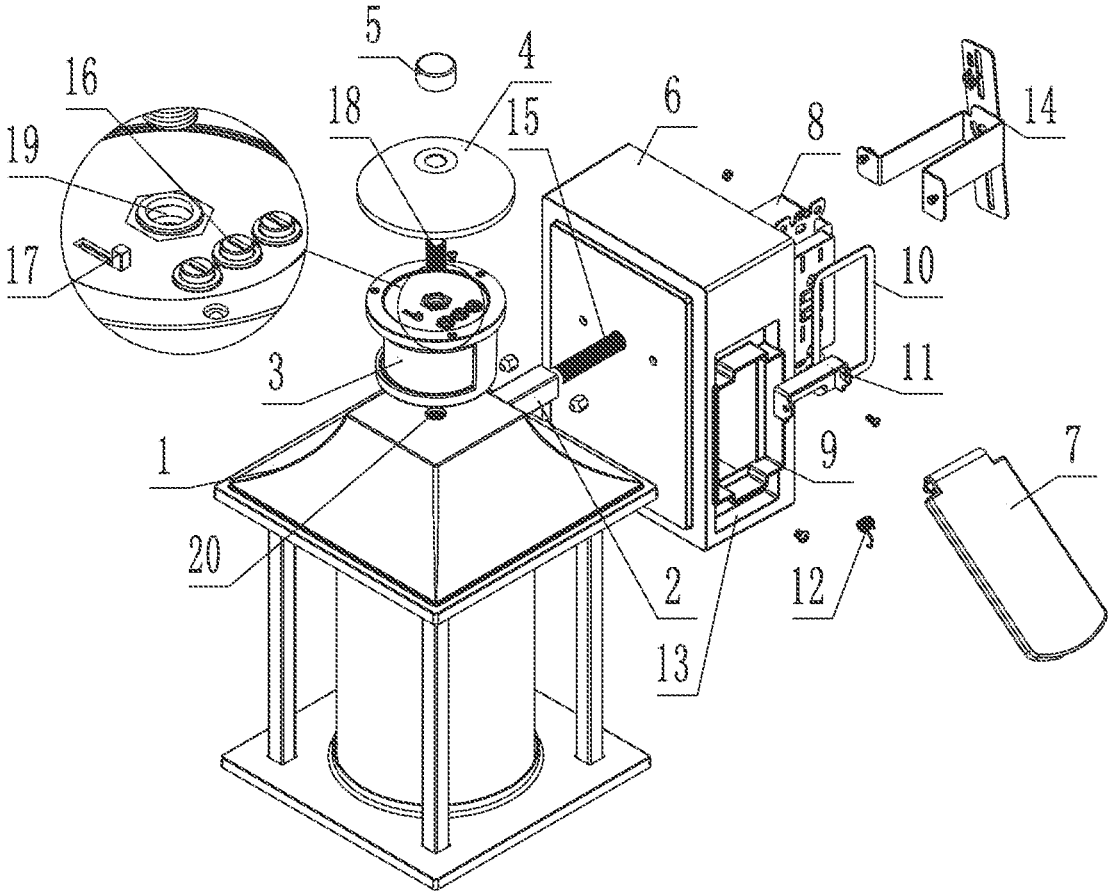
FIG. 4 is a schematic exploded view of the structure in FIG. 1 according to the present invention.

The present invention will be described in further detail below in conjunction with the accompanying drawings and specific embodiments:

As shown in FIG. 1, FIG. 2, FIG. 3, and FIG. 4, a multifunctional outdoor waterproof wall lamp comprises a waterproof lamp 1. The top end of the waterproof lamp 1 is provided with a second connecting hole 20, a multifunctional sensor 3 is attached to the top end of the waterproof lamp 1 and provided with a first connecting hole 19, and the axial center of the first connecting hole 19 is aligned with the axial center of the second connecting hole 20. A waterproof cover 4 is attached to the top end of the multifunctional sensor 3. A hollow threaded rod 18 is threadedly connected in both the first connection hole 19 and the second connection hole 20, and the top end of the hollow threaded rod 18 passes through the waterproof cover 4 and is threadedly connected with an internally threaded aluminum piece 5. The waterproof lamp 1 is provided with a main body case 6 on one side. An internally threaded aluminum piece 2 is fixedly mounted to the waterproof lamp 1 on one side. One end of a connecting screw 15 is threadedly connected in the internally threaded aluminum piece 2, and the other end of the connecting screw 15 extends into the main body case 6 where a connecting nut 21 is provided, and the connecting nut 21 is threadedly connected with the connecting screw 15. A sensor adjustment switch 16 and a sensor mode switch 17 are fixedly mounted on the multifunctional sensor 3. A mounting groove 13 is provided on one side of the main body case 6, and a mounting shell 9 is fixedly embedded in the mounting groove 13. A sealing ring 10 is attached to one side of the mounting shell 9, a socket 8 is inserted into and slidably connected to the mounting shell 9, and the sealing ring 10 is disposed between the socket 8 and one side of the mounting shell 9. A bracket 14 is disposed in the main body case 6 and fixedly connected to an inner wall on one side of the main body case 6. An insulating shell 11 is fixedly mounted on an inner top surface of the mounting groove 13, a water blocking cover 7 is hinged in the insulating shell 11, and a torsion spring 12 is mounted at a movable joint between the water blocking cover 7 and the insulating shell 11.

The water blocking cover 7 is T-shaped as a whole and a hinge pin is inserted into the water blocking cover 7. The torsion spring 12 is sleeved on the hinge pin at the water blocking cover 7. One end of the torsion spring 12 is fixedly connected to the water blocking cover 7, and the other end of the torsion spring 12 is fixedly connected to an inner wall of the mounting groove 13.

The bracket 14 is formed by combining a transverse plate and a U-shaped plate via bolts, both ends of the U-shaped plate in the bracket 14 are threadedly connected with bolts respectively, and the U-shaped plate in the bracket 14 is threadedly connected with the inner wall on one side of the main body case 6 via bolts.

Gaskets are fixedly mounted at both the top end and the bottom end on one side of the socket 8 and provided with threaded holes where bolts are threadedly connected. The socket 8 are fixedly connected to the mounting shell 9 via a plurality of bolts.

The working principle is as follows: the device is mounted when in use; in the process of mounting, the bracket 14 should, be fixed to a wall first, and then wires are connected to the socket 8 in the main body case 6 so that the socket 8 can be powered on: then, the main body case 6 and the bracket 14 are mounted; after the mounting is completed, the waterproof lamp 1 is mounted; a power supply of the waterproof lamp 1 is connected, via wires, to wires in the wall through the internally threaded aluminum piece 2 and the connecting screw 15 to form a path, so that the waterproof lamp may operate normally; and in the main body case 6, when the socket 8 is needed, the water blocking cover 7 needs to be opened, and when the socket 8 is not needed, the water blocking cover 7 is automatically reset by the torsion spring 12, so that no water flows in.

With the sensor adjustment switch 16 and the sensor mode switch 17, usage modes of the device may be adjusted and switched well; with the socket 8, the device may be formed with an external power socket which is convenient for, the surrounding people to use, the applicable scenarios are more diverse and more convenient, the connection between products and the lamp is simple, and the compatibility is strong, which is convenient for replacing waterproof lamps 1 of various types; and with the waterproof cover 4, a good waterproof function can be realized, and after a product is preset, it can be directly powered on and used without repeated switching, thus realizing individual demand and energy saving, firm product structure, smart product structure, less visible screws and aesthetic appearance, and realizing multifunctional integration of smart lamps and sockets, convenient installation and long service life.

When the modes are switched, the device is provided with a multifunctional sensor 3, the multifunctional sensor 3 is provided with a light, control sensor that may sense daytime and night, and the device is provided with a human body sensor that may sense whether there is a person around. Also, the device is provided with the sensor adjustment switch 16 and the sensor mode switch 17, which may adjust various modes of the device. The adjustment process is as follows:

Light control mode: the lamp is not lighted during the daytime and always lighted at night;

Not lighted during the daytime: when a human activity is sensed at night, the lamp is turned on automatically (with 100% brightness); and after the human body leaves, the lamp is lighted (with 100% brightness) for a preset period of time (20 to 180 seconds) and then extinguishes automatically;

Not lighted during the daytime: when the brightness is low (LDM is set to be 0-50%), the lamp is turned on automatically and maintains the brightness; when a human body is sensed, a high brightness (100%) is maintained; and after the human body leaves, the low brightness is restored and the lamp remains turned on;

Not lighted during the daytime: after a human body is sensed, the high brightness (100%) lasts for a preset period of time (20 to 180 seconds) and then turns into the low brightness (LDM is set to be 0-50%).

The basic principles, main features, and advantages of the present invention are shown and described above. For those skilled in the art, it should be understood that the present invention is not limited by the above embodiments. The above descriptions of the embodiments and description merely illustrate the principle of the present invention. Various variations and improvements can be made to the present invention without, departing from the spirit, and scope of the present invention, and these variations and improvements should all fall within the claimed scope of the present, invention. The scope claimed in the present invention is defined by the appended claims and their equivalents.

What is claimed is:

1. A multifunctional outdoor waterproof wall lamp, comprising a waterproof lamp (1), wherein a top end of the waterproof lamp (1) is provided with a second connecting hole (20), a multifunctional sensor (3) is attached to the top end of the waterproof lamp (1) and provided with a first connecting hole (19), and an axial center of the first connecting hole (19) is aligned with an axial center of the second connecting hole (20); a waterproof cover (4) is attached to a top end of the multifunctional sensor (3); a hollow threaded rod (18) is threadedly connected in both the first connection hole (19) and the second connection hole (20), and a top end of the hollow threaded rod (18) passes through the waterproof cover (4) and is threadedly connected with an internally threaded aluminum piece (5); the waterproof lamp (1) is provided with a main body case (6) on one side and an internally threaded aluminum piece (2) is fixedly mounted to the waterproof lamp (1) on one side; one end of a connecting screw (15) is threadedly connected in the internally threaded aluminum piece (2), the other end of the connecting screw (15) extends into the main body case (6) where a connecting nut (21) is provided, and the connecting nut (21) is threadedly connected with the connecting screw (15); a sensor adjustment switch (16) and a sensor mode switch (17) are fixedly mounted on the multifunctional sensor (3); a mounting groove (13) is provided on one side of the main body case (6), and a mounting shell (9) is fixedly embedded in the mounting groove (13); a sealing ring (10) is attached to one side of the mounting shell (9), a socket (8) is inserted into and slidably connected to the mounting shell (9), and the sealing ring (10) is disposed between the socket (8) and one side of the mounting shell (9); a bracket (14) is disposed in the main body case (6) and fixedly connected to an inner wall on one side of the main body case (6); and the bracket (14) is fixed to an indoor wall; and an insulating shell (11) is fixedly mounted on an inner top surface of the mounting groove (13), a water blocking cover (7) is hinged in the insulating shell (11), and a torsion spring (12) is mounted at a movable joint between the water blocking cover (7) and the insulating shell (11).

2. The multifunctional outdoor waterproof wall lamp according to claim 1, wherein the water blocking cover (7) is T-shaped as a whole and a hinge pin is inserted into the water blocking cover (7), the torsion spring (12) is sleeved on the hinge pin at the water blocking cover (7), one end of the torsion spring (12) is fixedly connected to the water blocking cover (7), and the other end of the torsion spring (12) is fixedly connected to an inner wall of the mounting groove (13).

3. The multifunctional outdoor waterproof wall lamp according to claim 1, wherein the bracket (14) is formed by combining a transverse plate and a U-shaped plate via bolts, both ends of the U-shaped plate in the bracket (14) are threadedly connected with bolts respectively, and the U-shaped plate in the bracket (14) is threadedly connected with the inner wall on one side of the main body case (6) via bolts.

4. The multifunctional outdoor waterproof wall lamp according to claim 1, wherein gaskets are fixedly mounted at both a top end and a bottom end on one side of the socket (8) and provided with threaded holes, and the socket (8) is fixedly connected to the mounting shell (9) via a plurality of bolts passing through the threaded holes.

* * * * *